US012324956B2

(12) United States Patent
Ding

(10) Patent No.: US 12,324,956 B2
(45) Date of Patent: Jun. 10, 2025

(54) ABDOMINAL EXERCISE WHEEL

(71) Applicant: Quncou Ding, Yongkang (CN)

(72) Inventor: Quncou Ding, Yongkang (CN)

( * ) Notice: Subject to any disclaimer, the term of this patent is extended or adjusted under 35 U.S.C. 154(b) by 167 days.

(21) Appl. No.: 18/466,625

(22) Filed: Sep. 13, 2023

(65) Prior Publication Data

US 2025/0082990 A1 Mar. 13, 2025

(51) Int. Cl.
*A63B 23/02* (2006.01)
*A63B 21/00* (2006.01)
*A63B 22/20* (2006.01)

(52) U.S. Cl.
CPC ..... *A63B 23/0205* (2013.01); *A63B 21/4035* (2015.10); *A63B 21/4039* (2015.10); *A63B 22/20* (2013.01)

(58) Field of Classification Search
CPC ..... A63B 21/0004; A63B 21/4035; A63B 21/4039; A63B 21/4049; A63B 22/20; A63B 23/0205; A63B 23/0211
See application file for complete search history.

(56) References Cited

U.S. PATENT DOCUMENTS 2,069,384 A * 2/1937 Ogden ..... A63B 22/20 482/132
3,809,393 A * 5/1974 Jones ..... A63B 22/20 482/132
6,773,379 B1 * 8/2004 Bing ..... A63B 22/20 482/907
9,579,538 B2 * 2/2017 Brown ..... A63B 23/0211
11,426,624 B1 * 8/2022 Reisinger, Jr. ..... A63B 21/4035
2002/0082150 A1 * 6/2002 Smith ..... A63B 23/0211 482/139
2010/0004105 A1 * 1/2010 Peddar ..... A63B 22/20 482/132
2013/0017938 A1 * 1/2013 Thompson ..... A63B 23/1236 482/145
2017/0072258 A1 * 3/2017 Chen ..... A63B 21/0004
2019/0321678 A1 * 10/2019 Domesick ..... A63B 23/02

FOREIGN PATENT DOCUMENTS

FR 2817156 A3 * 5/2002 ..... A63B 21/0004
GB 2571639 A * 9/2019 ..... A63B 23/0211
GB 2620905 A * 1/2024 ..... A63B 23/02

* cited by examiner

*Primary Examiner* — Gary D Urbiel Goldner
(74) *Attorney, Agent, or Firm* — Michael Bartholomew

(57) ABSTRACT

An abdominal exercise wheel includes a base provided with a pair of upwardly curved grip rods. The base is provided with three groups of pulley assemblies at a lower part of the base. The pulley assemblies are triangularly distributed below the base. A position of the pulley assemblies enables the pulley assemblies to support the base more stably while reducing side-turn over during use. Each pulley assembly includes a pulley seat and a pulley rotatably connected onto the pulley seat. The base is provided with elbow support members at two sides of the base, respectively. Each elbow support member includes a plurality of elbow support sheets. The plurality of elbow support sheets and corresponding elbow support surfaces are increased to reduce detachment of a user's elbows from the elbow support sheet during use.

6 Claims, 2 Drawing Sheets

ABDOMINAL EXERCISE WHEEL

TECHNICAL FIELD

The present invention relates to the technical field of an abdominal exercise wheel, and specifically discloses an abdominal exercise wheel.

BACKGROUND

An abdominal exercise wheel is a small propeller which may exercise muscles and a joint, and reduce weight. The abdominal exercise wheel is generally made of a high-quality engineering plastic. The abdominal exercise wheel has simple design and beautiful appearance, and is durable, easy to use, used to exercise a flab of an abdomen, a waist and hips, arms, and other parts of a body. Because a site required for exercise is simple, the abdominal exercise wheel is easy to be used at home.

The abdominal exercise wheel in the prior art is generally provided with two groups of parallel pulleys at the bottom. In the event that the ground is slippery or uneven, the abdominal exercise wheel is likely to lead to side-turn over, resulting in injury to a user. In addition, the abdominal exercise wheel is provided with an elbow support sheet at the two sides. The elbow support sheet at one side of the abdominal exercise wheel in the prior art has a smaller area. This is likely to cause that the contact surface between the elbow support sheet and the elbow is not enough. The elbow is likely to be detached from the elbow support sheet, resulting in a potential safety hazard.

SUMMARY

In order to solve the above problem, the present invention adopts the following technical solution:

The present invention provides an abdominal exercise wheel, including a base. The base is provided thereon with an upwardly curved grip rod. The base is provided with three groups of pulley assemblies at the lower part. The pulley assemblies are triangularly distributed below the base. The pulley assembly includes a pulley seat and a pulley rotatably connected onto the pulley seat. The base is provided with elbow support members at the two sides. The elbow support member includes a plurality of elbow support sheets.

Further, the elbow support sheets located on one side of the base are parallel to each other.

Further, the base is provided thereon with a timer.

Further, the base is provided thereon with a fixing plate. A cell phone or a tablet computer may be placed between the fixing plate and the base.

Further, a connecting member is provided between the grip rods. The grip rod is provided thereon with a non-slip sleeve.

Further, the pulley seat and the bottom of the base are fixed to each other by a screw, and the base is provided with a plurality of reinforcing ribs interlaced with each other at the bottom. The present invention has the following beneficial effects: the technical solution provides an abdominal exercise wheel, including a base. The base is provided thereon with an upwardly curved grip rod. The base is provided with three groups of pulley assemblies at a lower part. The pulley assemblies are triangularly distributed below the base. The pulley assembly includes a pulley seat and a pulley rotatably connected onto the pulley seat. The base is provided with elbow support members at the two sides. The elbow support member includes a plurality of elbow support sheets. For the technical solution, the position of the pulley assembly is redesigned, so that the pulley assembly supports the base more stably and are less likely to side-turn over during use. In addition, the elbow support sheet and the elbow support surface are increased, so that the elbow is not easy to be detached from the elbow support sheet. In the technical solution, the abdominal exercise wheel has a compact structure and a high level of safety performance.

BRIEF DESCRIPTION OF DRAWINGS

In order to explain embodiments of the present invention or the technical solutions in the prior art more clearly, the following briefly introduces the drawings that need to be used in the description of the embodiments or the prior art. Obviously, the drawings in the following description are only some of the embodiments of the present invention. The person skilled in the art may obtain others drawings based on structures shown in these drawings without creative labor.

In the figures: 1—base, 101—reinforcing rib, 2—timer, 3—fixing plate, 4—elbow support member, 401—elbow support sheet, 5—grip rod, 501—non-slip sleeve, 6—connecting member, 7—pulley assembly, 701—pulley, 702—pulley seat.

DETAILED DESCRIPTION OF EMBODIMENTS

To enable a person skilled in the art to better understand the embodiments of the present application, the following clearly and completely describes the technical solutions in embodiments of the present application in conjunction with the accompanying drawings in the embodiments of the present application. Obviously, the described embodiments are a part of the embodiments of the present application, rather than all embodiments. Based on the embodiments of the present invention, all other embodiments obtained by a person skilled in the art without creative labor shall fall within the protection scope of the present invention.

Figure 1:
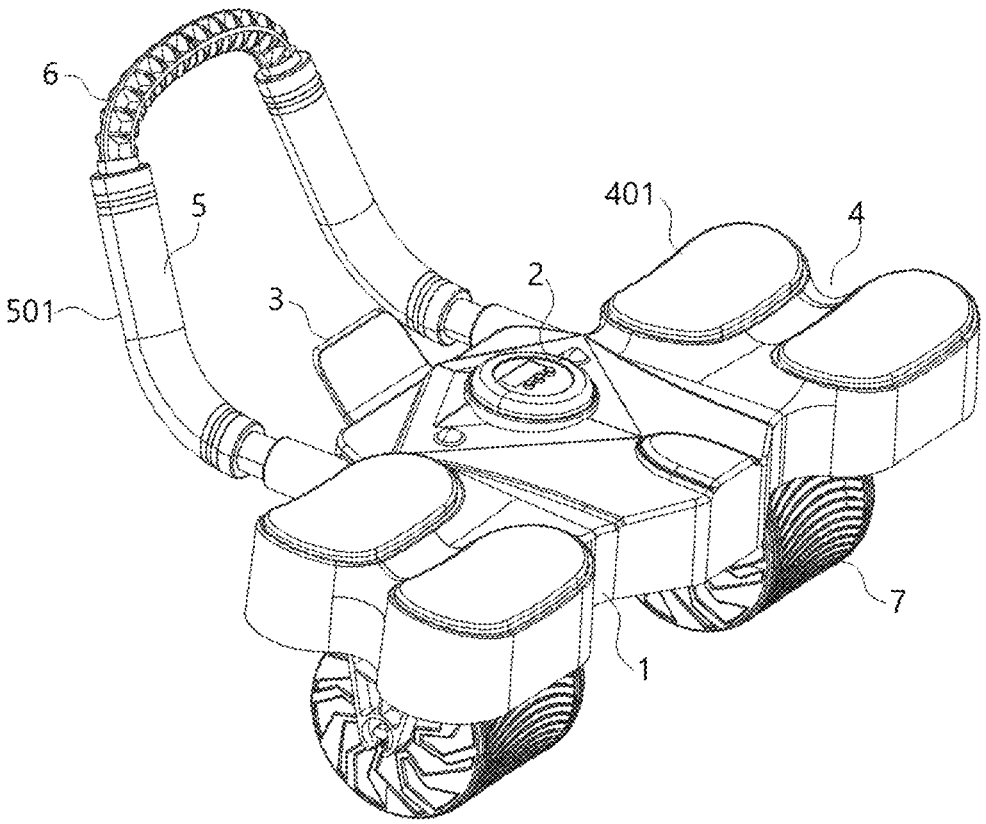
FIG. 1 is a three-dimensional view of an abdominal exercise wheel of the present invention.
Figure 2:
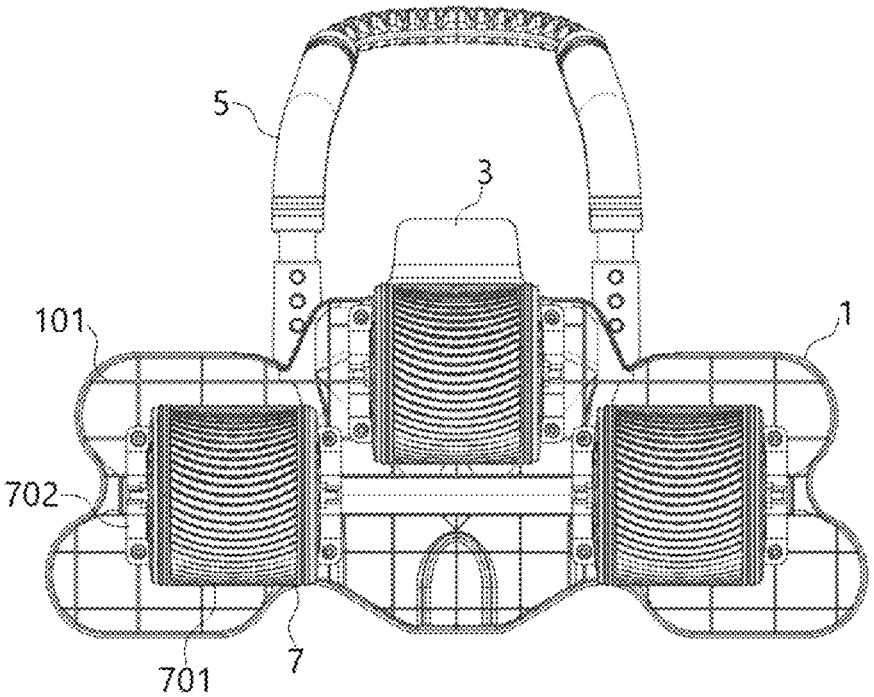
FIG. 2 is an upward view of an abdominal exercise wheel of the present invention.

Referring to FIGS. 1-2, an abdominal exercise wheel includes a base 1. The base 1 is provided thereon with an upwardly curved grip rod 5. The base 5 is provided with three groups of pulley assemblies 7 at a lower part. The pulley assemblies 7 are triangularly distributed below the base 1. The pulley assembly 7 includes a pulley seat 702 and a pulley 701 rotatably connected onto the pulley seat 702. The base 1 is provided with elbow support members 4 at the two sides. The elbow support member 4 includes a plurality of elbow support sheets 401. For the technical solution, the position of the pulley assembly 7 is redesigned, so that the pulley assembly 7 supports the base 1 more stably and are less likely to side-turn over during use. In addition, the elbow support sheet 401 and the elbow support surface are increased, so that the elbow is not easy to be detached from the elbow support sheet. In the technical solution, the abdominal exercise wheel has a compact structure and a high level of safety performance.

As a preferred implementation of the embodiment, the elbow support sheets 401 located on one side of the base 1 are parallel to each other and more attached to the elbow.

Specifically, the base 1 is provided thereon with a timer 2.

Specifically, the base 1 is provided thereon with a fixing plate 3. A cell phone or a tablet computer may be placed between the fixing plate 3 and the base 1.

Specifically, a connecting member 6 is provided between the grip rods 5. The grip rod 5 is provided thereon with a non-slip sleeve 501, which may improve slip resistance between a user and the grip rod.

Further, the pulley seat 702 and the bottom of the base 1 are fixed to each other by a screw, and the base 1 is provided with a plurality of reinforcing ribs 101 interlaced with each other at the bottom. The reinforcing rib 101 may enhance the overall strength of the base 1.

From the above description, it can be seen that the above embodiments of the present invention realize the following technical effects:

The present invention has the following beneficial effects: the technical solution provides an abdominal exercise wheel, including a base. The base is provided thereon with an upwardly curved grip rod. The base is provided with three groups of pulley assemblies at a lower part. The pulley assemblies are triangularly distributed below the base. The pulley assembly includes a pulley seat and a pulley rotatably connected onto the pulley seat. The base is provided with elbow support members at the two sides. The elbow support member includes a plurality of elbow support sheets. For the technical solution, the position of the pulley assembly is redesigned, so that the pulley assembly supports the base more stably and are less likely to side-turn over during use. In addition, the elbow support sheet and the elbow support surface are increased, so that the elbow is not easy to be detached from the elbow support sheet. In the technical solution, the abdominal exercise wheel has a compact structure and a high level of safety performance.

It should be noted that the terms used here are only for describing specific embodiments, and are not intended to limit the exemplary embodiments according to the present application. As used herein, a singular form is intended to include a plural form as well, unless a context clearly indicates otherwise. It should also be understood that when the terms "comprising" and/or "including" are used in this specification, these terms indicate the presence of a feature, a step, an operation, a device, an assembly, and/or a combination thereof.

Relative arrangement, numerical expressions and numerical values of components and steps set forth in these embodiments do not limit the scope of the present application unless otherwise specified. In addition, it should be understood that for ease of description, the dimensions of various components shown in the accompanying drawings are not drawn in actual proportional relationship. A technique, the method, and an apparatus known to a person skilled in the art may not be discussed in detail, but where appropriate, the techniques, the method, and the apparatus should be considered as part of authorized description. In all of the examples shown and discussed herein, any specific value should be interpreted as being merely exemplary and not as limitations. Thus, other examples of exemplary embodiments may have different values. It should be noted that similar reference numerals and letters indicate similar items in the following drawings. Therefore, once a certain item is defined in one drawing, the item does not need to be further discussed in the subsequent drawings.

In the description of the present application, it is to be understood that orientation terms such as "front, rear, up, down, left, right", "transverse, longitudinal, vertical, perpendicular, horizontal" and "top, bottom" are not indicative of an orientation or positional relationship generally based on the orientation or positional relationship shown in the accompanying drawings, but are used solely for the objective of facilitating the description of the present application and simplifying the description. In the absence of an opposite statement, these orientation or positional terms do not indicate and imply that a device or an element referred to has a specific orientation or be constructed and operated in the specific orientation. Therefore, it cannot be construed as a limitation on the scope of protection of the present application. Further, the orientation or positional terms "inside and outside" refer to inside and outside in relation to the contours of various components themselves.

It should be understood that when one element is referred to as being "on" or "connected to" another element, the element may be directly on or directly connected to that element, or there may be an indirect connection with an inserted element between the two. Conversely, when one element is referred to as being "directly" on or "directly connected to" another element, there is no inserted element between the two.

In addition, it should be noted that in the description of the present invention, terms such as "first", "second" and so on are used to define elements or components and are only for the objective of facilitating the differentiation of the corresponding elements or components. The forgoing terms do not have any special meanings if the terms are not otherwise declared. Therefore, the terms cannot be construed as a limitation of the scope of protection of the present application. In the description of the present invention, the meaning of "a plurality of" refers to two or more than two, unless otherwise specified.

The forgoing merely describes preferred embodiments of the present invention. It should be pointed that for those skilled in the art, some improvements and polishments, which also fall within the protection scope of the present invention, may be made without departing the principle of the present invention.

What is claimed is:

1. An abdominal exercise wheel, comprising a base, wherein the base is provided thereon with a pair of upwardly curved grip rods, the base is provided with three groups of pulley assemblies at a lower part of the base, the pulley assemblies are triangularly distributed below the base, each pulley assembly comprises a pulley seat and a pulley rotatably connected onto the pulley seat, the base is provided with elbow support members at two sides of the base, respectively, and each elbow support member comprises a plurality of elbow support sheets.

2. The abdominal exercise wheel according to claim 1, wherein the plurality of elbow support sheets located on one side of the base are parallel to each other.

3. The abdominal exercise wheel according to claim 2, wherein the base is provided thereon with a timer.

4. The abdominal exercise wheel according to claim 3, wherein the base is provided thereon with a fixing plate, and a cell phone or a tablet computer is capable of being placed between the fixing plate and the base.

5. The abdominal exercise wheel according to claim 4, wherein a connecting member is provided between the pair of upwardly curved grip rods, and each upwardly curved grip rod is provided thereon with a non-slip sleeve.

6. The abdominal exercise wheel according to claim 1, wherein the pulley seat and a bottom of the base are fixed to each other by a screw, and the base is provided with a plurality of reinforcing ribs interlaced with each other at the bottom of the base.

* * * * *